United States Patent [19]

Kühnert

[11] Patent Number: 5,055,384

[45] **Date of Patent: * Oct. 8, 1991**

[54] GRANULATED PHOTOGRAPHIC FIXATIVE AND ITS PREPARATION

[75] Inventor: Peter Kühnert, Leverkusen, Fed. Rep. of Germany

[73] Assignee: Agfa Gevaert Aktiengesellschaft, Leverkusen, Fed. Rep. of Germany

[ * ] Notice: The portion of the term of this patent subsequent to May 8, 2007 has been disclaimed.

[21] Appl. No.: 537,893

[22] Filed: Jun. 13, 1990

[30] Foreign Application Priority Data

May 10, 1989 [DE] Fed. Rep. of Germany ..... 3933226
Jun. 27, 1989 [DE] Fed. Rep. of Germany ..... 3920920

[51] Int. Cl.[5] ..... G03C 5/38; G03C 5/44

[52] U.S. Cl. ..... 430/450; 430/393; 430/458; 430/459; 430/460; 430/461; 430/465

[58] Field of Search ..... 430/450, 458, 459, 460, 430/461, 465, 393

[56] References Cited

U.S. PATENT DOCUMENTS

| | | | |
|---|---|---|---|
| 2,543,086 | 2/1951 | Wiitala | 95/88 |
| 3,615,508 | 10/1971 | Stephen et al. | 96/60 BF |
| 4,923,786 | 5/1990 | Kuhnert et al. | 430/450 |

*Primary Examiner*—Charles L. Bowers, Jr.
*Assistant Examiner*—Janis L. Dote
*Attorney, Agent, or Firm*—Connolly & Hutz

[57] ABSTRACT

A granulated photographic fixative or bleach fixative composed of grains containing both a thiosulphate and a disulphite is mechanically stable, dust free and freely pourable, will keep indefinitely and is distinguished by its great speed of solution.

5 Claims, No Drawings

GRANULATED PHOTOGRAPHIC FIXATIVE AND ITS PREPARATION

This invention relates to a granulated photographic fixative and to a process for the preparation of such a fixative which is rapidly soluble.

Photographic fixatives and bleach fixatives conventionally contain a thiosulphate as fixing agent which is required to dissolve undeveloped silver halide and silver halide newly formed by bleaching of the metallic silver from the photographic material. The thiosulphate used is frequently ammonium thiosulphate [$(NH_4)_2S_2O_3$] on account of its rapid fixing reaction but it has one serious disadvantage. Powders of this substance cake together to form solid lumps when left to stand even when atmospheric moisture is excluded, and these lumps must then be carefully broken down and are difficult to dose. This effect also occurs when the ammonium thiosulphate powder is mixed with the other constituents of the fixing or bleach fixing bath. Sodium thiosulphate which may be used as a substitute for ammonium thiosulphate, on the other hand, has the disadvantage that it is difficult to dissolve in water and forms crusts at the bottom of the fixing or bleach fixing bath. To overcome this difficulty, the fixative or bleach fixative is in most cases marketed and used as a liquid preparation. This has the disadvantage of increased cost due to the water ballast.

It is an object of the present invention to provide a form of preparation of ammonium thiosulphate which is solid and yet can easily be dosed and will dissolve rapidly in the bath.

It has now been found that granulated fixatives may be prepared by milling a thiosulphate together with a disulphite and optionally other solid substances so that the particle diameter distribution curve will have its maximum below 10 μm, and subjecting the milled particles to a powder agglomeration, drying the granulate in a vacuum, optionally mixing the granulate with the granulate of the bleaching agent, and packaging the product in a sealed container which is impervious to water vapour.

The resulting granulates of the solid constituents of a photographic fixative or bleach fixative are mechanically stable and uniform in particle size, dissolve very rapidly, will keep indefinitely and are free from dust and freely pourable.

The thiosulphates are preferably alkali metal thiosulphates, in particular the sodium salt, and ammonium thiosulphate.

The disulphites may be alkali metal or ammonium disulphite, in particular sodium disulphite.

Size reduction of the solid constituents to particle sizes below 10 μm is normally carried out by jet milling. Powder agglomeration is preferably carried out in a fluidized bed, optionally with the addition of a granulating liquid, e.g. 200 ml of water per kg of powder, and a small quantity of binder, e.g. corn starch, to the articles which are to be agglomerated.

The average particle diameter of the granulates is preferably ≧150 μm, in particular from 150 to 3000 μm.

Complex formers such as ethylene diaminotetracetic acid (ETDA) and substances for adjusting the pH, such as sodium carbonate, may be used as additional constituents of the thiosulphate granulates.

For the preparation of bleach fixatives, the granulates of fixative and of bleaching agent are preferably prepared separately and subsequently mixed together.

The granulate of bleaching agent contains an iron(III) complex or an iron(III) complex salt, e.g. an ammonium iron complex salt of EDTA, of propylene diaminotetracetic acid (PDTA), of diethylene triaminopentacetic acid (DTPA) or of nitrilotriacetic acid (NTA) and optionally free complex formers, e.g. EDTA, PDTA, DTPA or NTA.

The granulate of bleaching agent is preferably prepared by exactly the same method as the granulate of fixative and in particular has an average particle diameter in the same range.

The substance according to the invention preferably contains from 35 to 85% by weight of thiosulphate, 5 to 15% by weight of disulphite and, in the case of a bleach fixative, from 30 to 50% by weight of an iron(III) complex or iron(III) complex salt.

EXAMPLE 1

Preparation of a Bleach Fixing Bath Granulate for Processing Colour Negative Paper The bleach fixing bath granulate is prepared by mixing two individual granulates A and B. The following quantities of substance are used per liter of prepared solution ready for use:

| | |
|---|---|
| 1. Granulate A: | |
| 1.1 ammonium thiosulphate | 75.0 g |
| 1.2 ammonium carbonate | 2.6 g |
| 1.3 sodium disulphite | 13.5 g |
| | 91.1 g |
| 2. Granulate B: | |
| 2.1 ammonium-iron-EDTA | 57.0 g |
| 2.2 EDTA acid | 0.8 g |
| | 57.8 g |

Preparation of Granulate A

The chemicals mentioned under A mixed together in the proportions indicated are broken down to a particle size of about 1 mm in a so called Alexander mill and then milled to a particle size of 5 μm in an air jet mill. The milled material is then granulated in portions of about 500 gram in a commercial fluidized layer granulator (Strea-1-Laboratory Apparatus of Aeromatic, Bubendorf/Switzerland).

50 ml of water used as granulating liquid are sprayed into the fluidized bed within about b 2 minutes. The product is then dried for about 6 minutes by heating the fluidizing air to 70° C. until the product is at a temperature of 60° C. The undersized particles (<0.15 mm), amounting to about 5% of the product, are removed from the correctly sized particles by sifting. The product is then redried in a vacuum at room temperature.

The colourless product obtained does not clump together and is nondusting and freely pourable.

Preparation of Granulate B

The chemicals mentioned under B are mixed together and granulated in about 7 minutes in the same granulator as that used for A by spraying them with 50% by weight of ammonium-iron-EDTA solution containing excess ammonia. 200 ml of this solution are sprayed on 600 g of mixture B at room temperature.

The product is then dried for 10 minutes in the same apparatus by heating the fluidizing air to 70° C. until the product reaches a temperature of 55° C. After removal of a small quantity of oversized grain by sifting, the product is dried in a vacuum at room temperature for 3 to 4 hours. The reddish brown, pourable product obtained is dust free and does not form clumps.

Mixing

For the preparation of the mixed granulates ready for use, granulates A and B are mixed together. The mixture of 91.1 g of granulate A and 57.8 g of granulate B contains the quantity of mixed granulate required for 1 liter of bleach fixing bath.

Properties of the finished mixed granulate

The mixed granulate is free flowing and nondusting like the individual granulates. When stirred in water at room temperature it dissolves in 45 seconds to form a dark red solution. This does not differ from a second sample prepared from an equal quantity of the corresponding pulverulent chemicals.

The mixed granulate will keep indefinitely when packaged air tightly and free from moisture. The photographic activity is identical to that of a bleach fixing bath prepared from the same formulation but without granulation.

EXAMPLE 2

Preparation of a Fixing Bath Granulate for Processing Colour Negative or Black and White Films The following solid chemicals are mixed together in the ratios indicated for the preparation of a granulate for 1 liter of solution ready for use:

| | |
|---|---|
| 1. ammonium thiosulphate | 140.0 g |
| 2. EDTA acid | 1.2 g |
| 3. sodium disulphite | 13.9 g |
| 4. ammonium carbonate | 30.0 g. |

After size reduction in the so called Alexander mill, the mixture is milled to an average particle size of about 5 μm in an air jet mill.

About 700 g of such a mixture are granulated in the Strea 1-granulator described above within 5 minutes by spraying the mixture with 110 ml of water. The spraying process is interrupted several times to ensure uniform grain size distribution. The granulate obtained is then dried for 10 minutes by heating the fluidizing air to 55° C. Small quantities of oversized and undersized grain are sifted off. The product is then dried in a vacuum at room temperature for 2 hours.

The colourless granulate is dust free, free flowing and non-clumping. When sealed into aluminium-laminated bags, it will keep indefinitely. It dissolves in water with stirring within about 10 seconds to form a colourless, clear solution with a pH of 7.3.

In its photographic action, this solution is identical to that of a second solution which has been prepared from the same formulation of chemicals without granulation.

I claim:

1. Granulated photographic fixing or bleach fixing agent, the granulates having an average particle diameter of from 150 to 3000 μm and containing both a thiosulfate and a disulphite.

2. Granulated photographic bleach fixing agent according to claim 1, in addition containing a granulate of an iron(III) complex or of an iron(III) complex salt.

3. Granulated photographic fixative or bleach fixative according to claim 1, the granulate containing from 35 to 85% by weight of thiosulphate and from 5 to 15% by weight of disulphite.

4. Granulated photographic fixative or bleach fixative according to claim 2, the granulate containing from 30 to 50% by weight of an iron(III) complex or an iron(III) complex salt.

5. A process for the preparation of a photographic fixative or bleach fixative in granulated form containing a thiosulphate, characterised in that the thiosulphate is milled together with a disulphite and optionally other solid substances so that the particle diameter distribution curve has its maximum below 10 μm, the milled particles are subjected to a powder agglomeration, and the granulate is dried under vacuum, optionally mixed with the granulate of bleaching agent and packaged in a damp proof package.

* * * * *